United States Patent [19]

Swisher

[11] 4,394,820

[45] Jul. 26, 1983

[54] DOUBLE ACTION BARREL LOCK

[76] Inventor: James A. Swisher, 464 Mill Hill Dr., Southport, Conn. 06490

[21] Appl. No.: 236,747

[22] Filed: Feb. 23, 1981

[51] Int. Cl.[3] ..... E05B 67/36

[52] U.S. Cl. ..... 70/34; 70/386; 70/395

[58] Field of Search ..... 70/34, 32, 33, 386, 70/395, 23

[56] References Cited

U.S. PATENT DOCUMENTS

| | | | |
|---|---|---|---|
| 3,186,196 | 6/1965 | Moberg | 70/34 |
| 3,835,674 | 9/1974 | Hoyt | 70/34 |
| 4,063,434 | 12/1977 | Moberg | 70/34 |
| 4,155,232 | 5/1979 | Haus | 70/34 |

*Primary Examiner*—Robert L. Wolfe

*Attorney, Agent, or Firm*—Robert E. Ross

[57] ABSTRACT

A lock of the type having an elongated housing open at the rear end with internal operating mechanism to release locking means, in which the mechanism comprises a collar which is spring biased forwardly and a locking stem mounted in the collar and spring biased rearwardly in relation thereto. The insertion of an operating tool causes movement of the stem forwardly a predetermined amount, allowing the tool to engage the collar. However, the insertion of a picking tool into the collar forces the stem forwardly in relation to the collar, a greater distance increasing the overall length of the mechanism to an extent that even when the collar is moved rearwardly as far as possible, the forward end of the stem does not move rearwardly far enough to release the locking means. In one embodiment of the invention, the end of the stem protrudes far enough that operating tools normally used for this type of lock cannot be used to open the lock.

10 Claims, 8 Drawing Figures

DOUBLE ACTION BARREL LOCK

BACKGROUND OF THE INVENTION

In the electric meter box art it is becoming increasingly necessary to provide positive means for locking the cover of the meter box closed, to prevent unauthorized persons from gaining access to the terminals inside the box. Locking is often accomplished by the use of a so-called barrel lock or plunger lock, such as is shown in my U.S. Pat. No. 3,186,196 issued June 1, 1965.

This lock comprises a housing and a pair of balls which are moved outwardly into the locking position by an internal axially movable plunger. The plunger is spring biased to the locking position, and is moved to the unlocking position by the insertion of an expandable tool into the end of a hollow stem of the plunger. The tool frictionally grips the internal walls of the stem so that tension can be applied to the plunger to pull it, against the force of the spring, to the unlocking position.

However, it has been found that it is possible to jam an article, such as a wire with a suitably bent end, into the stem cavity and with sufficient perseverance to obtain sufficient frictional engagement with the internal stem wall to pull the plunger to the unlocking position.

Also, tools for opening such locks are often lost or stolen, and find their way into the hands of unauthorized persons.

SUMMARY OF THE INVENTION

To reduce the possibility of defeating a lock of this type, I have provided a lock in which the locking plunger consists of a first member for engagement by an operating tool, and a locking pin carried by the first member.

The first member is biased away from the tool receiving opening and thereby maintains the locking pin in the locking position. The locking pin extends through the first member and is biased in relation to the first member in a direction so as to maintain the locking plunger at a predetermined minimum length. The dimensions of the components are such that when the first member is engaged by an operating tool and pulled, the locking pin can be moved far enough to allow the locking means to be released. However, when a picking tool is inserted into the first member in an effort to pull the lock open, the insertion of the picking tool causes the locking pin to move in relation to the first member to increase the overall length of the locking plunger, so that even if the locking plunger is pulled as far as possible toward the unlocking position the greater effective length of the plunger prevents the locking pin from moving far enough to release the locking means.

In one embodiment of the invention, the end of the locking pin, which extends through the first member, is so shaped and dimensioned that operating tools now in use cannot engage the first member without causing movement of the locking pin through the first member, which increases the overall length of the plunger, preventing such tools from unlocking the lock.

DESCRIPTION OF THE ILLUSTRATED EMBODIMENTS

Figure 3:
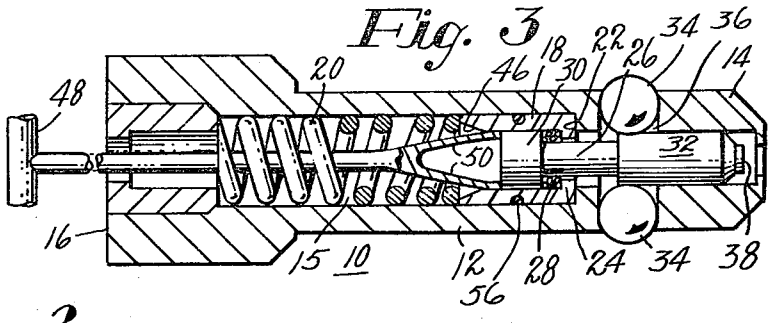
FIG. 3 is a view of the lock of FIG. 1 illustrating the effect on the position of the operating plunger of the insertion of a picking tool into the lock.
Figure 1:
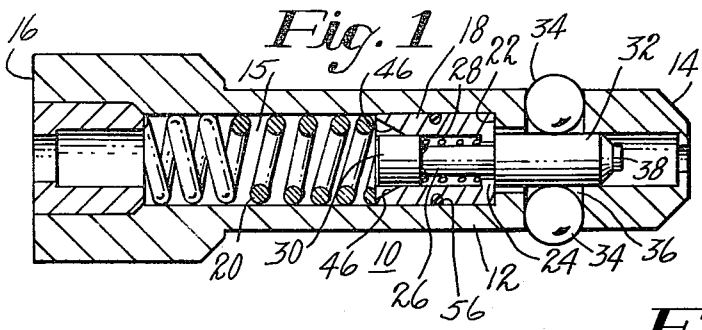
FIG. 1 is a view in side elevation, partly broken away and partly in section, of a lock embodying the features of the invention, in the locked position.

Referring to FIGS. 1–4, there is illustrated a lock 10, which comprises an elongated housing 12 having a closed forward end 14 and an internal cavity 15 opening to the rear end 16 of the housing. A lock operating mechanism is dispersed in the housing and comprises cup-shaped member 18 which is biased toward the forward end of the housing by a spring 20, and normally bears against a stop 22. The cup-shaped member 18 has a bottom 24 through which a locking pin 26 extends, said locking pin being biased rearwardly in the cup-shaped member 18 by a spring 28 disposed between the bottom 24 of the cup-shaped member and an enlarged head 30 in the locking pin.

The forward end of the pin has an enlarged locking portion 32 which controls the radial movement of a pair of locking balls 34 which are retained in aperture 36 in the housing wall. The parts are so dimensioned that when the pin is in the locking position (that is, with the cup-shaped member biased forwardly against the stop and the locking pin biased rearwardly so that the locking position 32 bears against the bottom of the cylinder, as in FIG. 1) the enlarged locking portion 32 is disposed between the balls, causing them to protrude from the outer surface of the housing.

When the locking pin is pulled rearwardly far enough, the forward end of the locking portion 32 moves out from between the balls, so that they can move inwardly to the unlocking position, resting on a reduced end portion 38.

The lock operating mechanism of FIGS. 1–4 is intended for receiving in the cup-shaped member 18 a lock operating tool 39 of the type that has an end portion with expanding fingers 40 disposed about a mandrel 42 which has an enlarged head 44. Movement of the operating handle 46 first moves the mandrel head 44 into the space between the fingers, causing said fingers to move outwardly to grip the inner surface of the cup-shaped member, and then causes the mandrel and fingers to move as a unit to pull the cup-shaped member rearwardly, whereby also moving the locking pin rearwardly.

The components are so dimensioned in relation to each other and to the dimensions of the hereinbefore described operating tool that in order to move the locking pin far enough rearwardly, after insertion of the operating tool, to allow the balls to move inwardly to the un-locking position, the cup-shaped member 18 must be moved rearwardly far enough to completely compress the spring 20.

In the embodiment of FIGS. 1–4, when the components are in the locked position (See FIG. 1) the enlarged head 30 of the locking pin 26 is so positioned that the rear end (left end in FIG. 1) is at about the same axial position as the rear end of the cup-shaped member 19. The rear portion of the wall of the cup-shaped member is provided with a beveled inner surface 46, and the dimensions of the components of the lock and the operating tool are such that on insertion of the operating tool, the locking pin 26 is moved forwardly by the mandrel 42 into the cup-shaped member to that as the fingers 40 expand on the mandrel, they can grip the inner surface of the cup-shaped member. (See FIG. 2)

The movement of the locking pin by the insertion of the operating tool therefore increases the effective length of the lock operating mechanism (that is, the distance between the rear end of the cup-shaped member and the forward end of the locking pin) a predetermined amount, so that when the operating tool pulls the cup-shaped member rearwardly to completely compress the spring 20, the reduced end portion 38 will just reach a position opposite the balls 34 to allow them to retract into the housing to release the lock.

Figure 4:
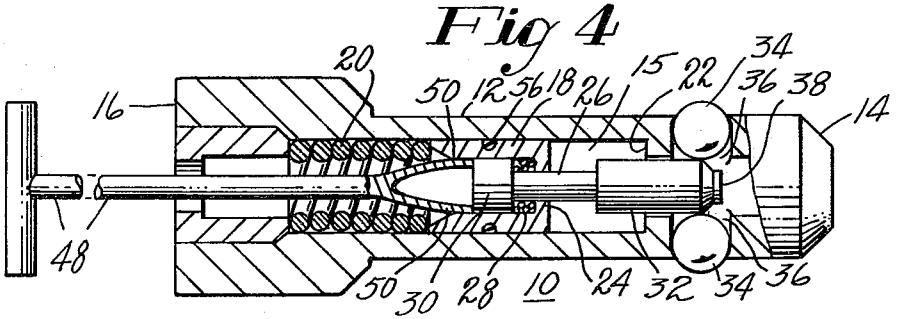
FIG. 4 is a view of the lock and picking tool of FIG. 3, illustrating an attempt to open the lock by pulling on the picking tool.
Figure 5:
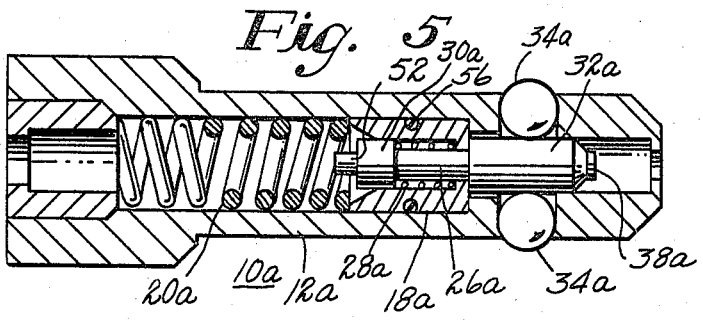
FIG. 5 is a view in side elevation, partly broken away and partly in section of a modified form of lock embodying the features of the invention.
Figure 6:
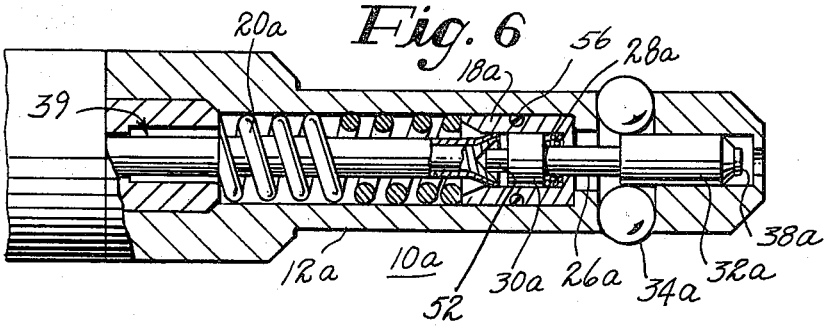
FIG. 6 is a view of the lock of FIG. 5 with the lock operating key of FIG. 2 assembled therewith, illustrating the effect on the insertion of said key on the position of the operating plunger.
Figure 7:
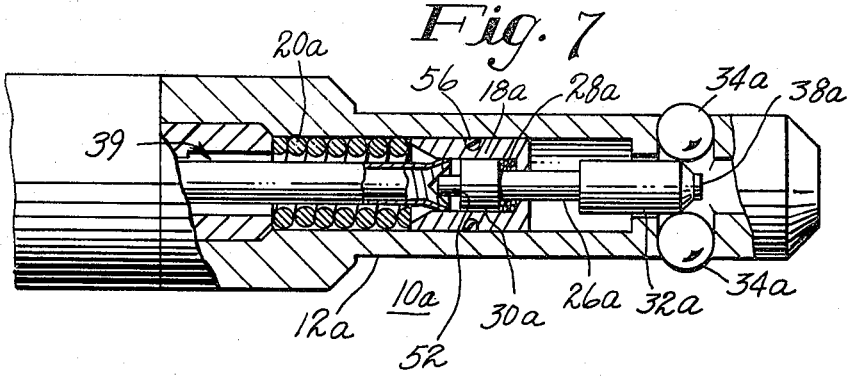
FIG. 7 is a view of the assembly of FIG. 6, illustrating an attempt to open the lock with the key illustrated therein.
Figure 8:
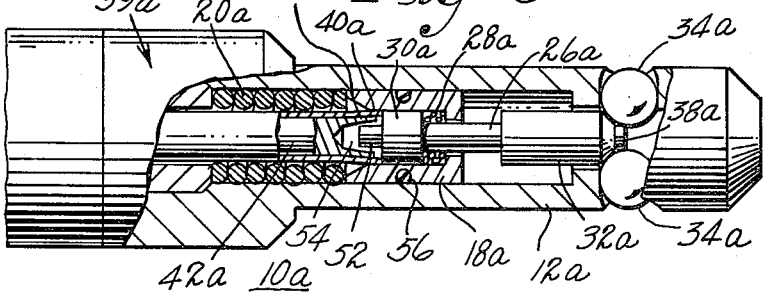
FIG. 8 is a view of the modified form of lock of FIG. 5 illustrating the use of a special key to open the lock.

The insertion of the operating tool does not cause complete compression of the spring 28, so that the effective length of the lock operating does not reach its maximum. However, when an attempt is made to open the lock by jamming a picking tool 48, having fingers 50, into the lock, the locking pin 26 will be forced into the cup-shaped member as far as possible, completely compressing the spring 28, and therefore increasing the effective length of the lock operating mechanism to the maximum. Therefore, as illustrated in FIG. 4, when the cup-shaped member is pulled by the picking tool to compress the spring 20 as much as possible, the reduced end portion 38 does not move far enough (to the left in FIG. 4) to reach a position that will allow the balls to retract into the housing.

It would, of course, be possible to dimension the components so that the enlarged head 30 of the locking pin 26 is initially recessed in the cup-shaped member, so that no forward movement of the pin 26 would occur on insertion of the operating tool. However, this structure, though operable, would not be as secure against opening by unauthorized persons as the lock of FIGS. 1–4, since a carefully inserted picking device could engage the inner surface of the cup-shaped member without depressing the locking pin.

Referring to FIGS. 5–8 of the drawing, there is illustrated a modified form of lock embodying the features of the invention.

The components of the lock of FIGS. 5–8 are similar to those of the lock of FIGS. 1–4, with the exception of the shape of the rear end of the locking pin **26*a* which is provided with a protrusion 52**.

Figure 2:
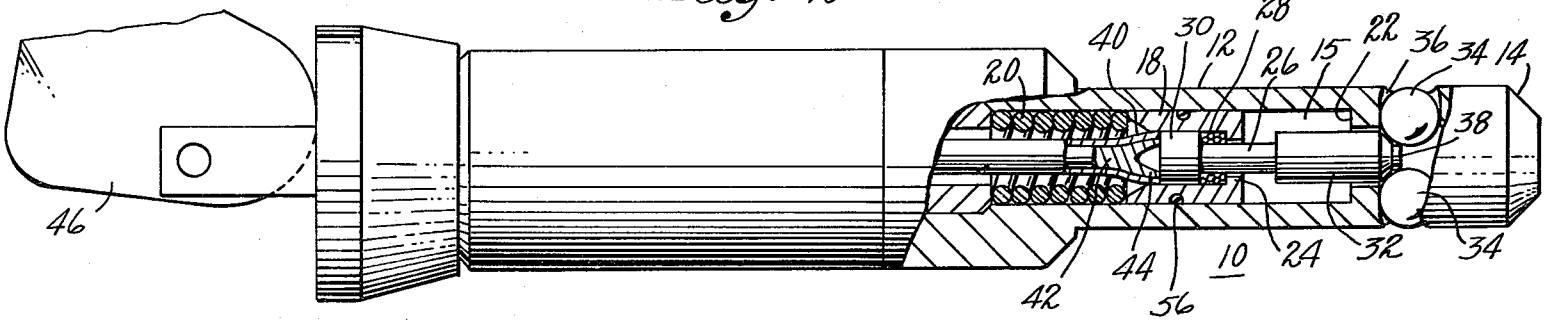
FIG. 2 is a view of the lock of FIG. 1 showing the action of an operating tool in opening the lock by pulling the operating plunger to the left to the unlocking position.

The presence of the protrusion 52 prevents the use of a commonly used type of operating tool 39 such as is shown in FIG. 2 to open the lock, since when this type of operating tool is inserted into the lock, the end of the mandrel 42 engages the protrusion 52 and moves the locking pin to the right. The presence of the protrusion will prevent some types of operating tools now in use from entering the cup-shaped member **18*a* far enough to allow the fingers to engage the inner wall surface thereof. However, if the fingers of a particular tool are able to grasp the inner wall of the cup-shaped member 18*a* (see FIGS. 6 and 7) the presence of the protrusion 52 causes the locking pin to move so far forwardly on insertion of the operating tool that the effective increase in length of the locking mechanism is such that when the locking mechanism is pulled rearwardly by the tool 39, the locking pin cannot move far enough to allow the reduced end portion 38*a*** to reach the unlocking position.

Therefore, to open the lock of FIGS. 5–8, a special tool **39*a* may be provided, which is similar to tool 39 of FIG. 2, with expanding fingers 40*a* disposed about a mandrel 42*a* having an enlarged head 44*a***.

To accommodate the projection 52, the mandrel head **44*a* is provided with a recess 54 so that on insertion of the tool into the lock, the amount of forward movement of the locking pin 26*a* is determined by the contact of the extreme forward end of the mandrel with the enlarged head 30*a* of the locking pin 26*a* and not by the protrusion 52. The amount of forward movement of the locking pin may be the same as occurs on insertion of tool 39 into the lock of FIGS. 1–4 so that on operation of the tool, the reduced end 38*a* of the locking pin 26 can move to the position opposite the balls 34*a*** to allow unlocking.

In either embodiment of the invention an "O" ring 54 may be provided in the outer surface of the cup-shaped member 18 or **18*a* to provide frictional engagement between the cup-shaped member and the inner surface of the housing 12. This frictional engagement prevents unauthorized release of the lock by cutting the spring 20 or by pulling on the coils of spring 20 with a hook or the like to compress the spring, and then axially jarring the lock to move the lock operating mechanism to the unlocking position. The "O" ring 54 also seals against the entry of water into the plunger cavity behind the cup-shaped member 18**.

Since certain changes apparent to one skilled in the art may be made in the illustrated embodiments of the invention without departing from the scope thereof, it is intended that all matter contained herein be interpreted in an illustrative and not a limiting sense.

I claim:

1. A lock of the type having a housing with an elongated aperture opening to the rear of the housing and a lock operating plunger axially movable in the housing, in which said plunger is formed of a rear tool engaging portion spring biased forwardly and a forward locking portion spring biased rearwardly so that the plunger normally has a predetermined overall length, and means engagable by an inserted picking tool to cause said forward locking portion to move forwardly in relation to the rear tool engaging portion to increase the overall length of the plunger.

2. A lock as set forth in claim 1 in which rear tool engaging portion has a rearwardly facing recess receiving the rear end of the locking portion, and spring means in the recess biasing the locking portion rearwardly in relation to the rear member.

3. A lock as set forth in claim 2 in which the rear end of the forward locking portion is so positioned as to be moved forwardly in the recess of the rear tool engaging portion a predetermined distance by the insertion of an operating tool, said distance being less than the maximum possible forward movement of the forward locking member in relation to the rear tool engaging portion.

4. A lock of the type having a housing with an internal elongated aperture opening to the rear end thereof, and an operating plunger assembly movable axially in the aperture, said assembly comprising a first member spring biased forwardly in the housing and a second member carried by the first member and being spring biased rearwardly in relation thereto so that said plunger assembly has a predetermined normal length, said second member having a forwardly extending locking portion which normally maintains locking means in a locking position, movement of said locking means rearwardly to a predetermined position by pulling on said first member being required to release said locking means, a rear portion of said second member being so positioned in relation to said first member as to be encountered by a picking tool inserted into the housing aperture to cause said second member to be moved forwardly in relation to the first member to increase the overall length of the plunger assembly, whereby movement of said first member rearwardly as far as possible does not move the locking portion of the second member to the position required to release the locking means.

5. A lock as set out in claim 4 in which said first member has a generally cupshaped recess facing rearwardly and said second member extends through the first member into the cupshaped recess.

6. A lock as set out in claim 5 in which the rear end of the second member is positioned to be moved forwardly in the cupshaped recess by an operating tool a predetermined distance less than the maximum possible forward movement caused by the insertion of a picking tool.

7. A lock of the type having a housing with an elongated aperture opening to the rear end thereof and locking means at the forward end thereof, an operating plunger movable axially in the aperture, said plunger having a variable length and comprising a rear tool engaging portion comprising a cylinder having a base forming a rearwardly facing cavity, said cylinder being biased forwardly by a main spring disposed between the cylinder and a rear portion of the housing, and a forward locking member having a medial portion extending through the base of the rear member, an enlarged head disposed in the cavity and a locking portion extending forwardly from the rear member to normally maintain locking means in the locking condition, auxiliary spring means disposed in the cavity biasing the forward member rearwardly in relation to the rear member, the components being so dimensioned that insertion of an operating tool causes the enlarged head to depress into the cavity a predetermined distance less than the maximum possible distance to increase the overall length of the plunger to a predetermined length, such that requires the main spring to be completely depressed to enable the locking means to retract to the unlocking position, the enlarged head being subject to being depressed a greater distance into the cavity when a picking tool is jammed into the lock aperture, whereby the overall length of the plunger assembly is so increased that when the plunger is moved to fully compress the main spring the locking means cannot retract to the unlocking position.

8. A lock of the type having a housing with an elongated apertute opening to the rear of the housing, a lock operating plunger axially movable in the housing aperture, spring means biasing the plunger to a locking position, and means disposed between the plunger and the adjacent surface of the housing to provide frictional engagement between the plunger and the housing, said frictional engagement being great enough to prevent movement of the plunger, in the absence of the biasing force of the spring, by impulses manually applied to the housing, yet not great enough to prevent the biasing force of the spring from returning the plunger to the locking position after the plunger is displaced therefrom.

9. A lock as set out in claim 8 in which said means providing frictional engagement comprises means mounted in the outer surface of said plunger.

10. A lock as set out in claim 8 in which said means providing frictional engagement comprises a peripheral member mounted in the outer surface of said plunger.

* * * * *